US012635793B1

(12) United States Patent
Do et al.

(10) Patent No.: US 12,635,793 B1
(45) Date of Patent: May 26, 2026

(54) STACKABLE AND EXTENDABLE STORAGE RACK

(71) Applicants: THANH PHONG PRODUCTION AND TRADE LIMITED COMPANY, Bac Ninh Province (VN); SUNRISE INDUSTRIES CORPORATION, Sacramento, CA (US)

(72) Inventors: Phu The Do, Bac Ninh Province (VN); Kim-Dung Thi Nguyen, Bac Ninh Province (VN)

(73) Assignees: HANH PHONG PRODUCTION AND TRADE LIMITED COMPANY, Bac Ninh Province (VN); SUNRISE INDUSTRIES CORPORATION, Sacramento, CA (US)

( * ) Notice: Subject to any disclaimer, the term of this patent is extended or adjusted under 35 U.S.C. 154(b) by 0 days.

(21) Appl. No.: 19/315,101

(22) Filed: Aug. 29, 2025

(51) Int. Cl.
*A47B 47/00* (2006.01)

(52) U.S. Cl.
CPC ..... *A47B 47/0091* (2013.01); *A47B 47/0083* (2013.01)

(58) Field of Classification Search
CPC ..... A47B 47/0091; A47B 47/0083; A47B 87/0276
See application file for complete search history.

(56) References Cited

U.S. PATENT DOCUMENTS 3,042,221 A * 7/1962 Rasmussen ..... A47B 57/50 211/183
3,048,245 A * 8/1962 Shewell ..... F16B 7/22 211/187
3,070,237 A * 12/1962 Fullerton ..... A47B 57/50 211/187
3,144,944 A * 8/1964 Mcconnell ..... A47B 57/50 211/192
3,194,408 A * 7/1965 Kimpton ..... A47B 57/402 211/183
3,217,894 A * 11/1965 Shewell ..... A47B 57/402 211/187
3,337,062 A * 8/1967 Seiz ..... A47B 57/26 211/192
3,352,584 A * 11/1967 Teofil ..... A47B 57/402 211/192
3,465,898 A * 9/1969 Klein ..... A47B 87/0215 211/188
3,506,138 A * 4/1970 Travis ..... A47B 55/02 108/53.5
3,512,653 A * 5/1970 Erismann ..... A47B 57/50 211/192

(Continued)

FOREIGN PATENT DOCUMENTS

DE 202019102020 U1 * 4/2019 ..... A47B 47/024
FR 3039383 B1 * 5/2018 ..... A47B 47/0091

*Primary Examiner* — Stanton L Krycinski
(74) *Attorney, Agent, or Firm* — Blue Capital Law Firm, P.C.

(57) ABSTRACT

A stackable and extendable storage rack is disclosed. In one embodiment, an object of the present invention is to provide storage racks that could be easily assembled or disassembled. Another object of the present invention is to provide storage racks that could be stacked vertically or extended horizontally to adapt to available storage space, and to provide more shelf space.

8 Claims, 19 Drawing Sheets

(56) References Cited

U.S. PATENT DOCUMENTS 3,741,405 A * 6/1973 McConnell ..... A47B 57/487 211/192
4,131,204 A * 12/1978 Jacoby ..... A47B 57/485 211/192
4,262,809 A * 4/1981 McConnell ..... A47B 57/50 403/317
4,382,518 A * 5/1983 Bondoux ..... A47B 57/50 248/222.41
5,517,928 A * 5/1996 Erdman ..... A47B 87/0207 403/375
8,172,098 B2 * 5/2012 Eustace ..... A47B 57/22 211/189
8,302,788 B2 * 11/2012 Vargo ..... A47B 57/50 211/186
9,027,767 B2 * 5/2015 Buckley ..... A47B 57/34 211/134
9,215,926 B1 * 12/2015 Offerman ..... A47B 47/02
9,237,803 B2 * 1/2016 Kassanoff ..... A47B 47/0091
9,282,820 B2 * 3/2016 Lo ..... A47B 87/0207
9,386,855 B2 * 7/2016 Sabounjian ..... A47B 96/14
9,456,688 B2 * 10/2016 Moyer ..... A47B 87/0276
9,474,369 B1 * 10/2016 Tsai ..... A47B 87/02
9,492,009 B2 * 11/2016 Naka ..... A47B 47/021
9,629,455 B2 * 4/2017 Shah ..... A47B 47/0083
9,661,921 B1 * 5/2017 Tsai ..... A47B 57/50
9,717,330 B2 * 8/2017 Reinhart ..... A47B 87/0223
10,100,526 B2 * 10/2018 Knudson ..... A47B 47/0091
10,238,207 B1 * 3/2019 Schenker ..... A47B 47/027
11,026,509 B2 * 6/2021 Walker ..... A47B 47/0083
11,033,105 B2 * 6/2021 Murphy ..... A47B 96/06
11,214,401 B1 * 1/2022 Emmitt ..... B65D 19/385
11,647,833 B2 * 5/2023 Hanlon ..... A47B 47/028 211/192
11,925,258 B2 * 3/2024 Chakraborthy ..... A47B 96/07
12,011,087 B1 * 6/2024 Liu ..... A47B 47/028
12,268,298 B2 * 4/2025 Hanlon ..... A47B 47/027
12,310,495 B2 * 5/2025 Chakraborthy .... A47B 47/0083
12,383,057 B2 * 8/2025 Beck ..... A47B 47/028
2008/0302746 A1 * 12/2008 Scholz ..... A47B 47/0091 211/153
2009/0277854 A1 * 11/2009 Eustace ..... A47B 57/22 211/183
2015/0282613 A1 * 10/2015 Chen ..... A47B 96/021 211/187
2017/0238702 A1 * 8/2017 Tsai ..... A47B 47/0083
2017/0238703 A1 * 8/2017 Tsai ..... A47B 57/50
2018/0279782 A1 * 10/2018 Liss ..... A47B 57/16
2018/0360234 A1 * 12/2018 Eichler ..... A47F 7/00
2019/0029416 A1 * 1/2019 Lu ..... A47B 57/50
2019/0150611 A1 * 5/2019 Burnett ..... A47B 7/00
2023/0270248 A1 * 8/2023 Hanlon ..... A47B 96/021
2023/0389699 A1 * 12/2023 Shan ..... A47B 96/1441
2023/0398678 A1 * 12/2023 Hanlon ..... A47F 5/01
2024/0090661 A1 * 3/2024 Chen ..... A47B 57/22
2024/0423360 A1 * 12/2024 Liu ..... A47B 47/0083
2025/0213036 A1 * 7/2025 Liu ..... A47B 47/028
2025/0325102 A1 * 10/2025 Li ..... A47B 96/1441

* cited by examiner

STACKABLE AND EXTENDABLE STORAGE RACK

FIELD

This disclosure generally relates to racks, and more particularly, to a storage rack that can be stacked vertically and/or extended horizontally.

BACKGROUND

Article-holding racks are used by people in their daily lives to hold common household articles such as towels, clothes, shoes, etc. Many of these racks can be disassembled to reduce that overall size and profile for storage and transportation. Unfortunately, many of these conventional racks are still difficult to assemble and disassemble, so that storage and transport can be inconvenient. It would be beneficial to provide a storage rack that can be easily disassembled for storage and transportation.

Furthermore, the conventional racks typically come in pre-configured sizes that may not be adaptable to configuration and size of particular storage or warehouse spaces available. It would be beneficial to provide a storage rack system that can be stacked vertically and/or extended horizontally as needed to adapt to particular storage or warehouse spaces available.

SUMMARY

An object of the present invention is to provide storage racks that could be easily assembled or disassembled. Another object of the present invention is to provide storage racks that could be stacked vertically or extended horizontally to adapt to available storage space, and to provide more shelf space.

Other features and advantages of the present inventive cabinet will appear and will be discussed more fully in the context of the drawings, the detailed description of the drawings and the claims.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts. Also, wherever possible, the same reference numbers will be used throughout the drawings to refer to the same or the like parts.

Figure 1:
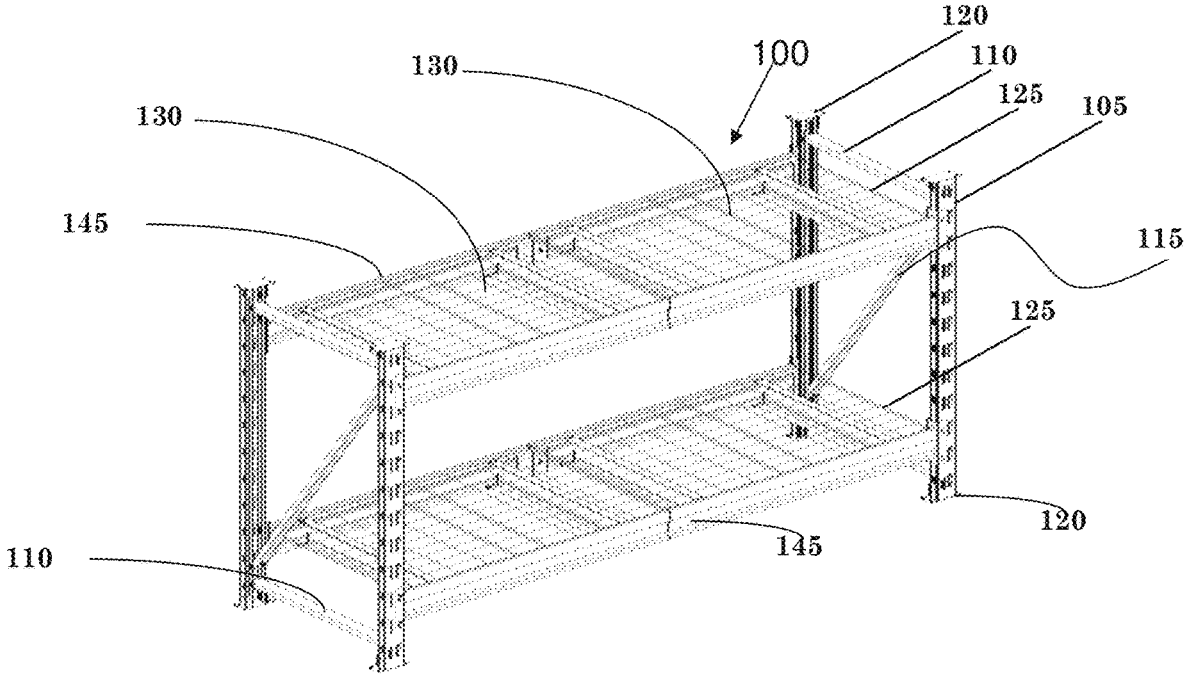
FIG. 1 shows an assembled rack according to one exemplary embodiment.
Figure 2A:
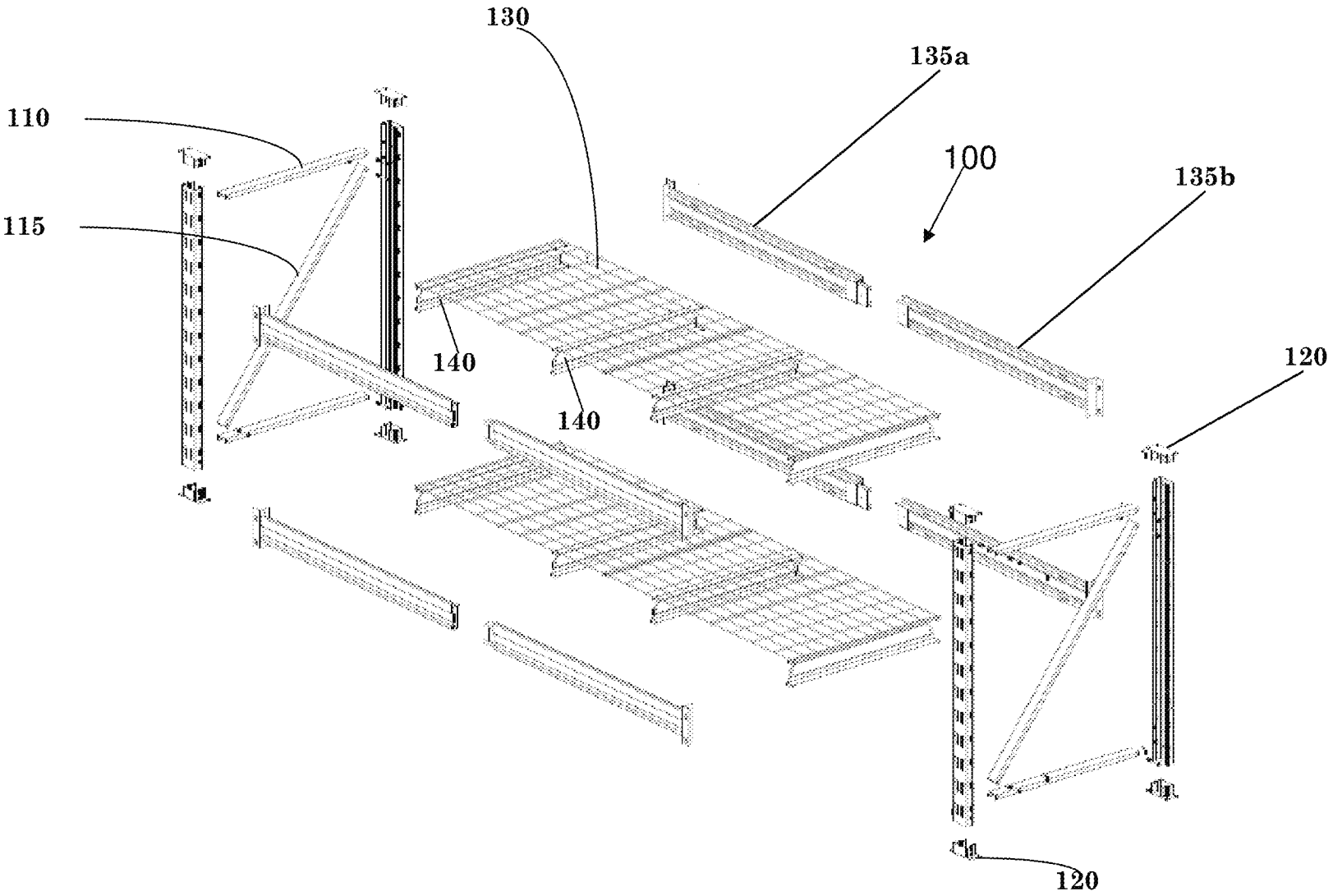
FIG. 2A shows an exploded view of the rack (shown in an assembled configuration in FIG. 1) according to one exemplary embodiment.
Figure 2B:
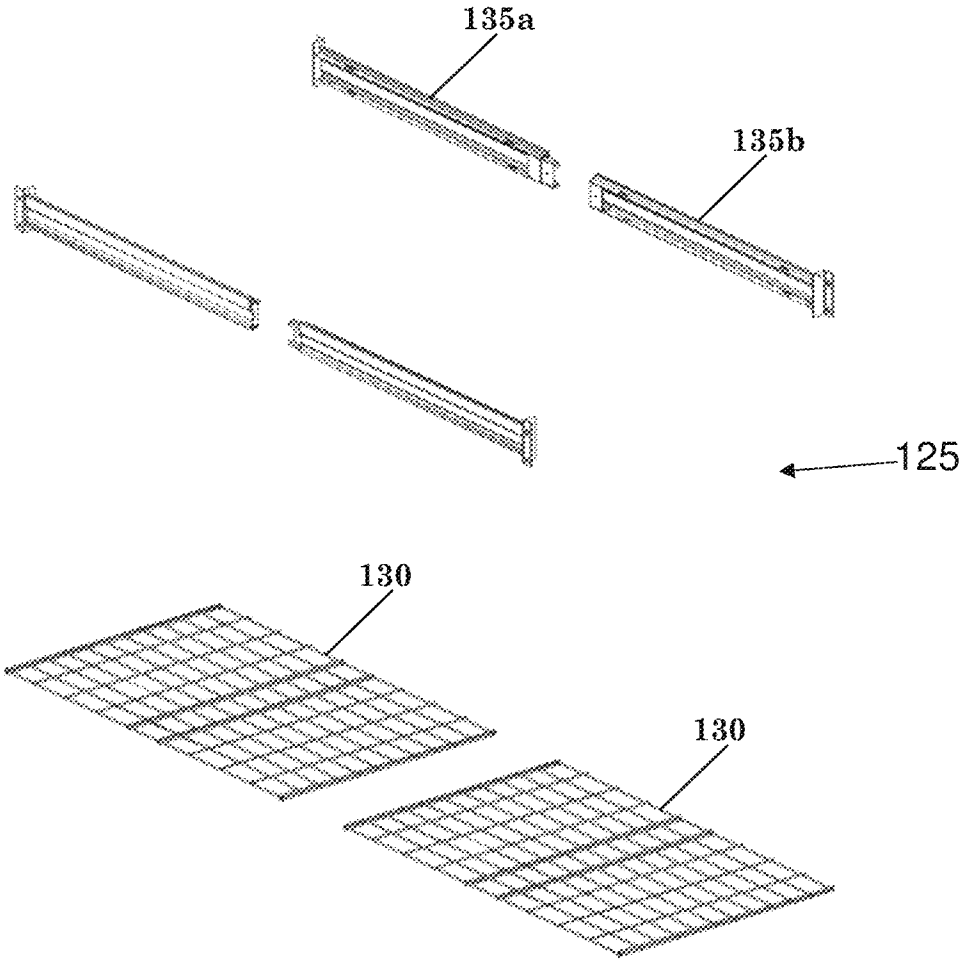
FIG. 2B shows an exploded view of a shelf (with support bars omitted) according to one exemplary embodiment.

FIG. 1 shows an assembled rack 100 according to one exemplary embodiment. FIG. 2A shows an exploded view of the rack 100 (shown in an assembled configuration in FIG. 1) according to one exemplary embodiment. FIG. 2B shows an exploded view of a shelf 125 (with support bars 140 omitted) according to one exemplary embodiment.

As shown in FIGS. 1, 2A, and 2B, the rack 100 has posts 105 positioned (in pairs) at the near end and the far end. The posts 105 are connected (in pairs) by horizontal arms 110. In one embodiment, the horizontal arms 110 can be secured to the posts using bolts (not shown) and lock nuts (not shown). Furthermore, diagonal arms 115 are secured to the horizontal arms 110 and the posts 105 to provide stability and support. In one embodiment, the diagonal arms 115 can be secured to the horizontal arms 110 and to the posts 105 using bolts (not shown) and lock nuts (not shown). Post caps 120 are inserted and coupled to the foot (or bottom) of the posts 105 to provide stability.

The shelves 125 are formed using half-size wire mesh decks 130, long beams halves (including left haves (LH) 135*a* and right halves (RH) 135*b*), and support bars 140. In one embodiment, each shelf 125 is formed using two half-size wire mesh decks 130. A long beam 145 is formed by coupling a long beam LH 135*a* to a long beam RH 135*b*. Two long beams 145 are positioned on each side of the half-size wire mesh decks 130 (as shown in FIGS. 2A and 2B) to form a shelf 125. In addition, to provide support for the shelf 125, support bars 140 are placed under the half-size wire mesh decks 130 at intervals, and are coupled to the long beams 145.

Once a shelf is formed or assembled, the shelves 125 can be connected to the posts 105 by coupling the ends of the long beams 145 to the posts 105. In one embodiment, the long beams 145 can be secured to the posts 105 using L-shaped pins (shown as element 150 in FIG. 3A). The use of L-shaped pins 150 generally facilitate easy assembling and disassembling of the rack 100. The user simply removes the L-shaped pins 150 to disassemble the shelves 125 from the rack 100.

Figure 3A:
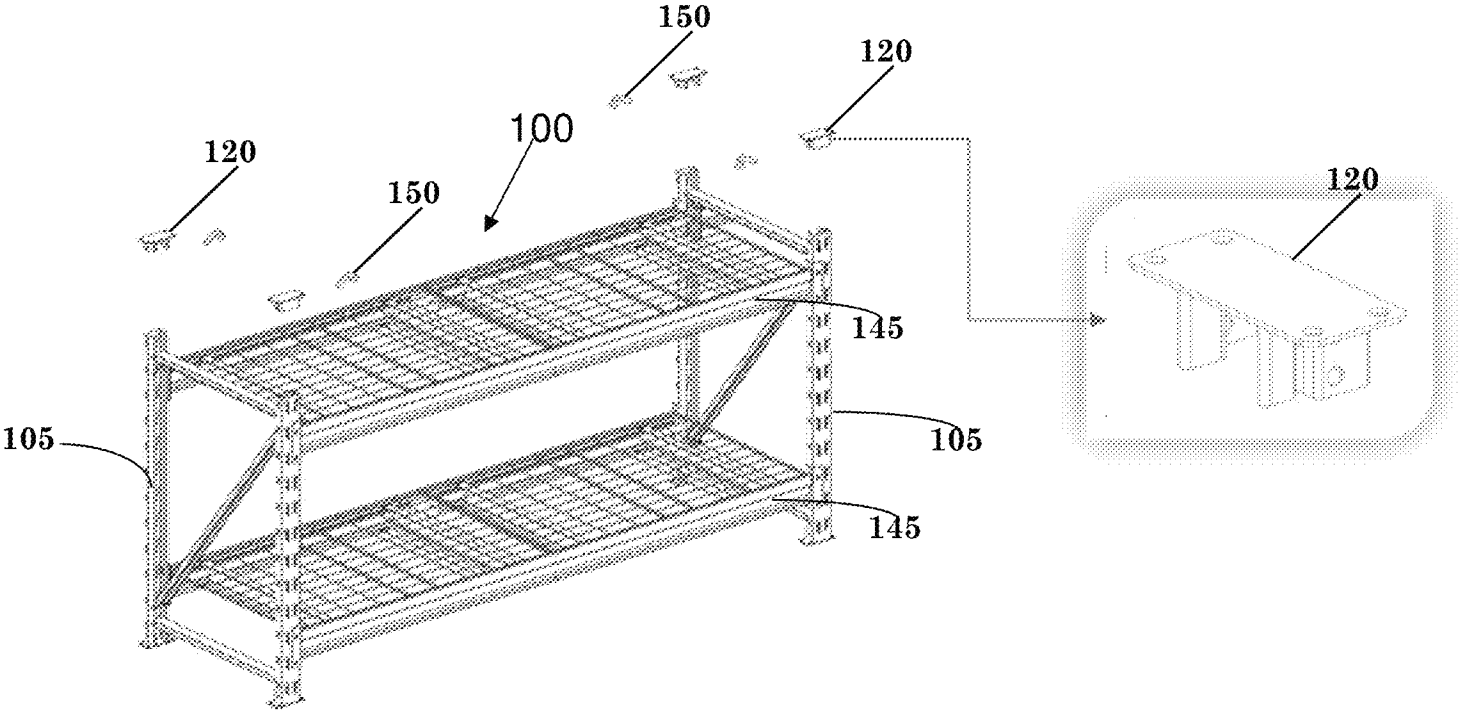
FIG. 3A shows an assembled rack with post caps according to one exemplary embodiment.

FIG. 3A shows an assembled rack 100 with post caps 120 according to one exemplary embodiment. The post caps 120 can be secured to the posts using L-shaped pins 150. The use of L-shaped pins 150 generally facilitate easy assembling and disassembling of the rack 100. The user simply removes the L-shaped pins 150 to disassemble the post caps 120 from the rack 100.

Figure 3B:
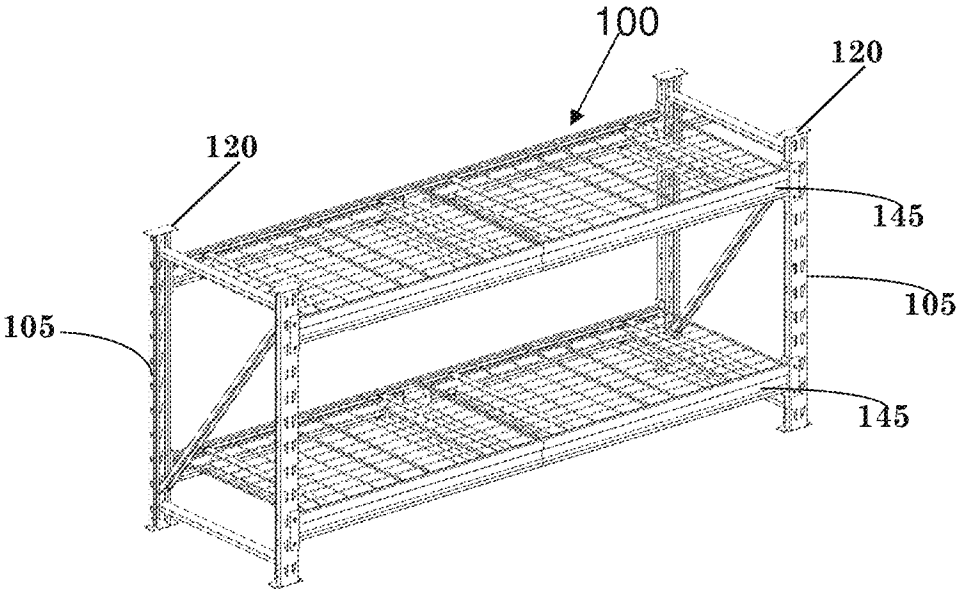
FIG. 3B shows an assembled rack with post caps coupled to the posts according to one exemplary embodiment.
Figure 3C:
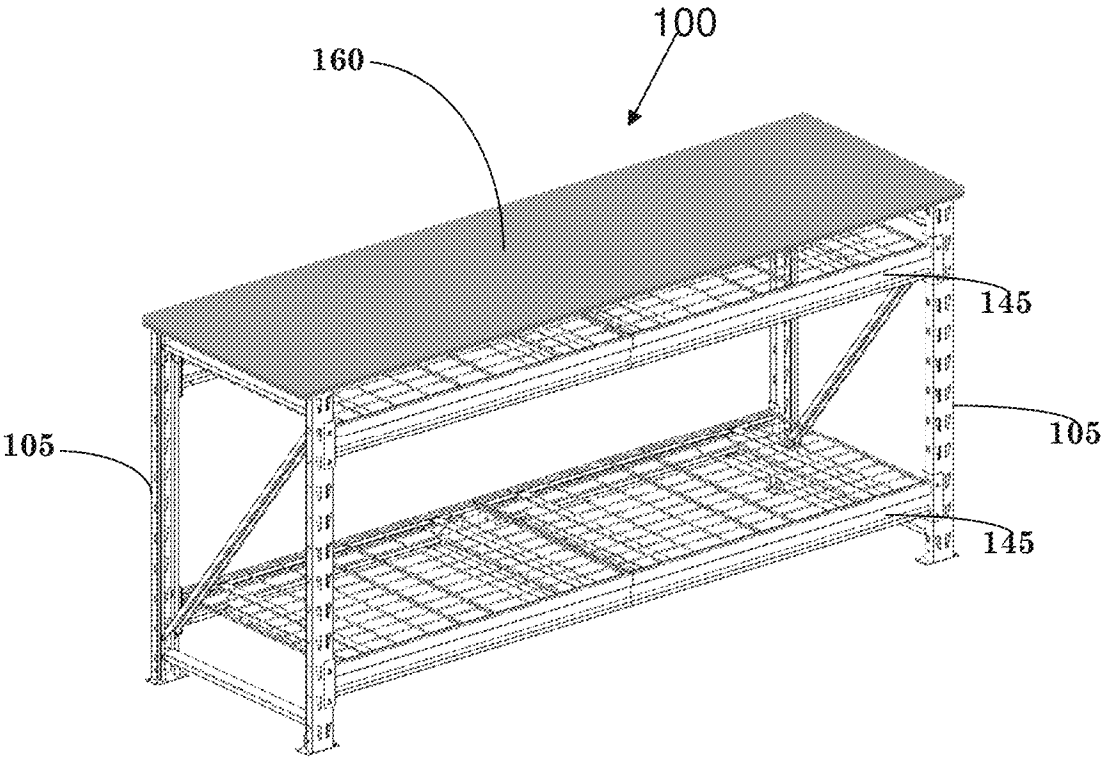
FIG. 3C shows a configuration where a flat board is placed on top of the assembled rack (shown in FIG. 3B) to form a table or workbench according to one exemplary embodiment.

FIG. 3B shows an assembled rack 100 with post caps 120 coupled to the posts 105 according to one exemplary embodiment. The post caps 120 covers the top of the posts as a safety feature to help the user avoid injury by inadvertently scraping against the top of the posts 105. Furthermore, each post cap 120 has a generally flat surface on which a flat board could be placed to form a table or a workbench. FIG. 3C shows a configuration where a flat board 160 is placed on top of the post caps (shown as elements 120 and 120 in FIGS. 3A and 3C) of the assembled rack 100 to form a table or workbench according to one exemplary embodiment.

Figure 4A:
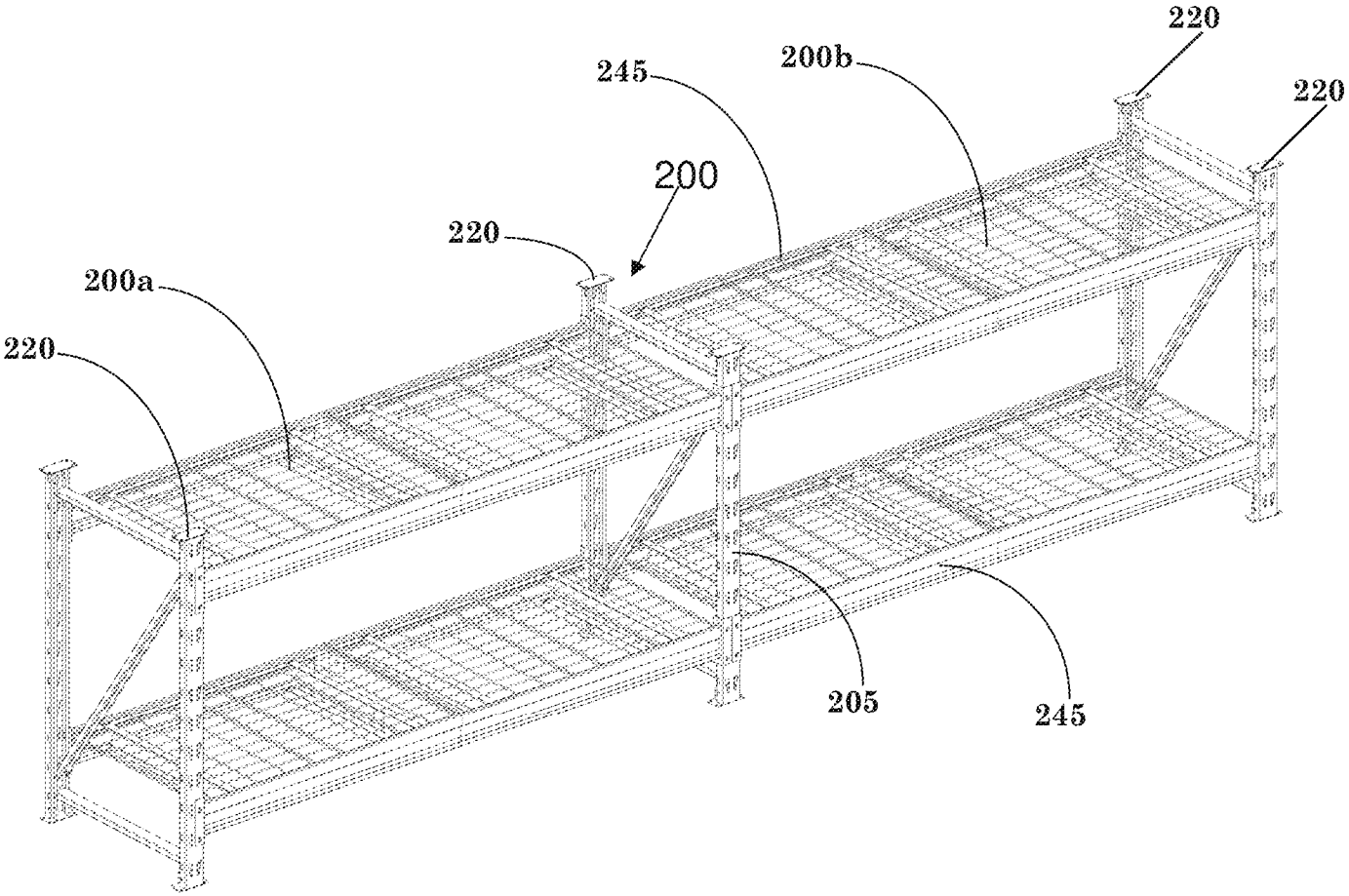
FIG. 4A shows two assembled racks coupled or connected together to form a 2-rack horizontally extended unit according to one exemplary embodiment.
Figure 4B:
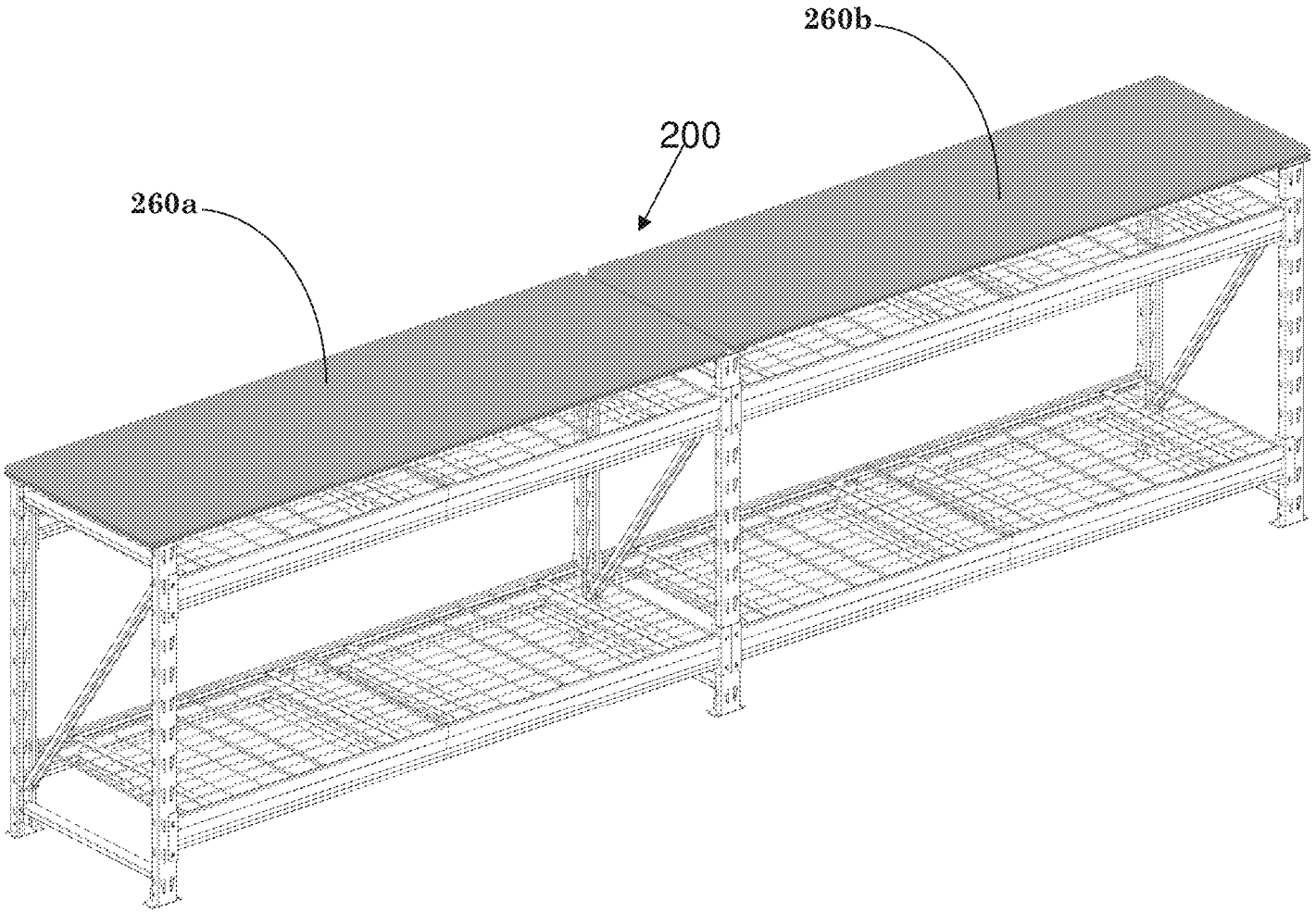
FIG. 4B shows a configuration where flat boards and are placed on top of the 2-rack horizontally extended unit (shown in FIG. 4A) to form an extended table or workbench according to one exemplary embodiment.

FIG. 4A shows two assembled racks 200*a* and 200*b* coupled or connected together to form a 2-rack horizontally extended unit 200 according to one exemplary embodiment. As shown in FIG. 4A, the long beams 245 of assembled rack 200*a* is coupled or connected to the posts 205 of assembled rack 200*b* to form the 2-rack horizontally extended unit 200. In one embodiment, L-shaped pins (shown as element 150 in FIG. 3A) can be used to secure the long beams 245 of assembled rack 200*b* to the posts 205 of assembled rack 200*a*. FIG. 4B shows a configuration where flat boards 260*a* and 260*b* are placed on top of the post caps (shown as element 220 in FIG. 4A) of the 2-rack horizontally extended unit 200 to form an extended table or workbench according to one exemplary embodiment.

Figure 4C:
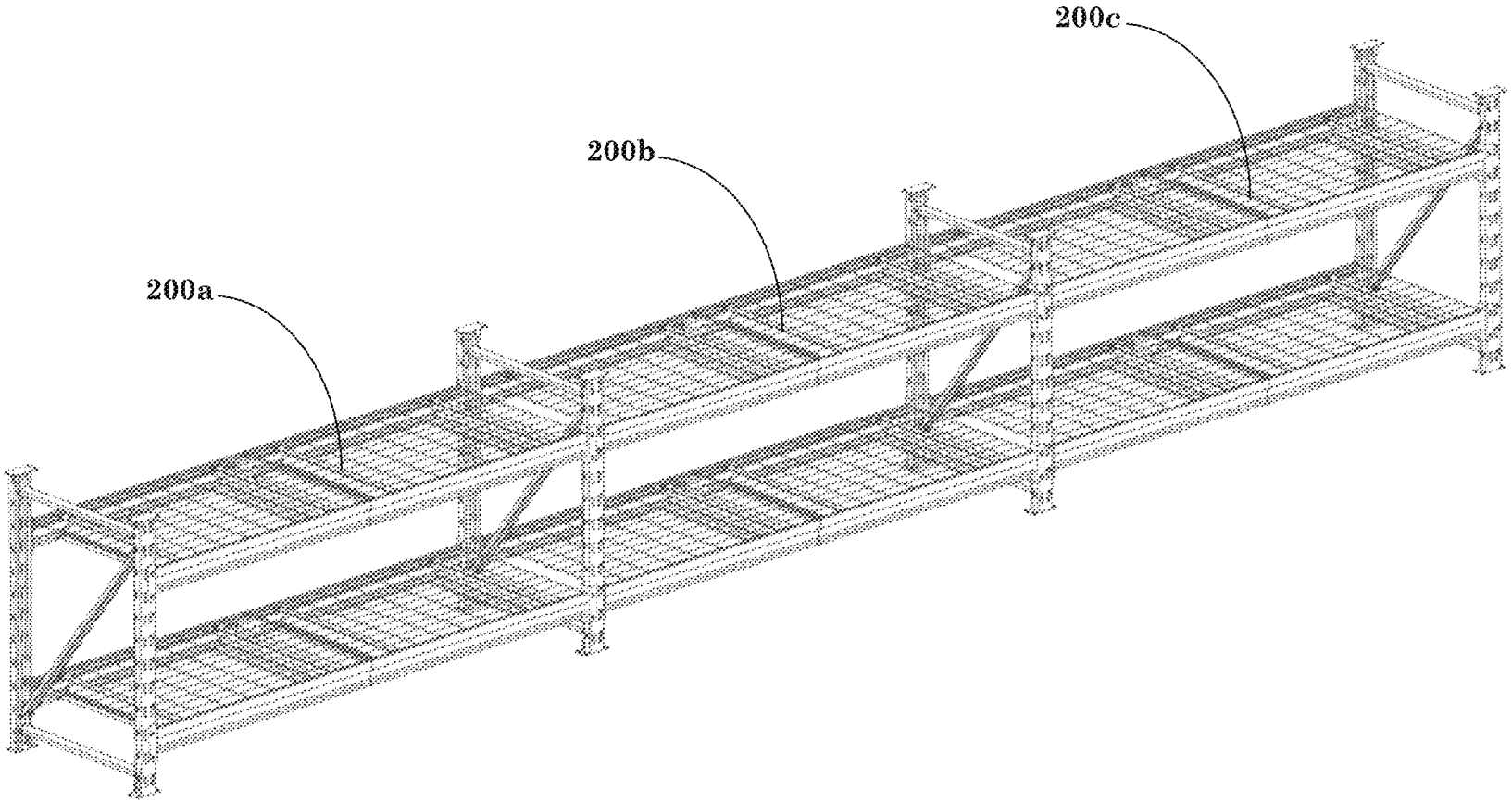
FIG. 4C shows three assembled racks coupled or connected together to form a 3-rack horizontally extended unit according to one exemplary embodiment

In alternative embodiments, 3 or more assembled racks can be coupled or connected together to form an even longer horizontally extended assembly than the one shown in FIGS. 4A and 4B. For example, as shown in FIG. 4C, 3 assembled racks 200*a*, 200*b*, and 200*c* are coupled or connected together to form a longer horizontally extended assembly than the one shown in FIGS. 4A and 4B.

Figure 5A:
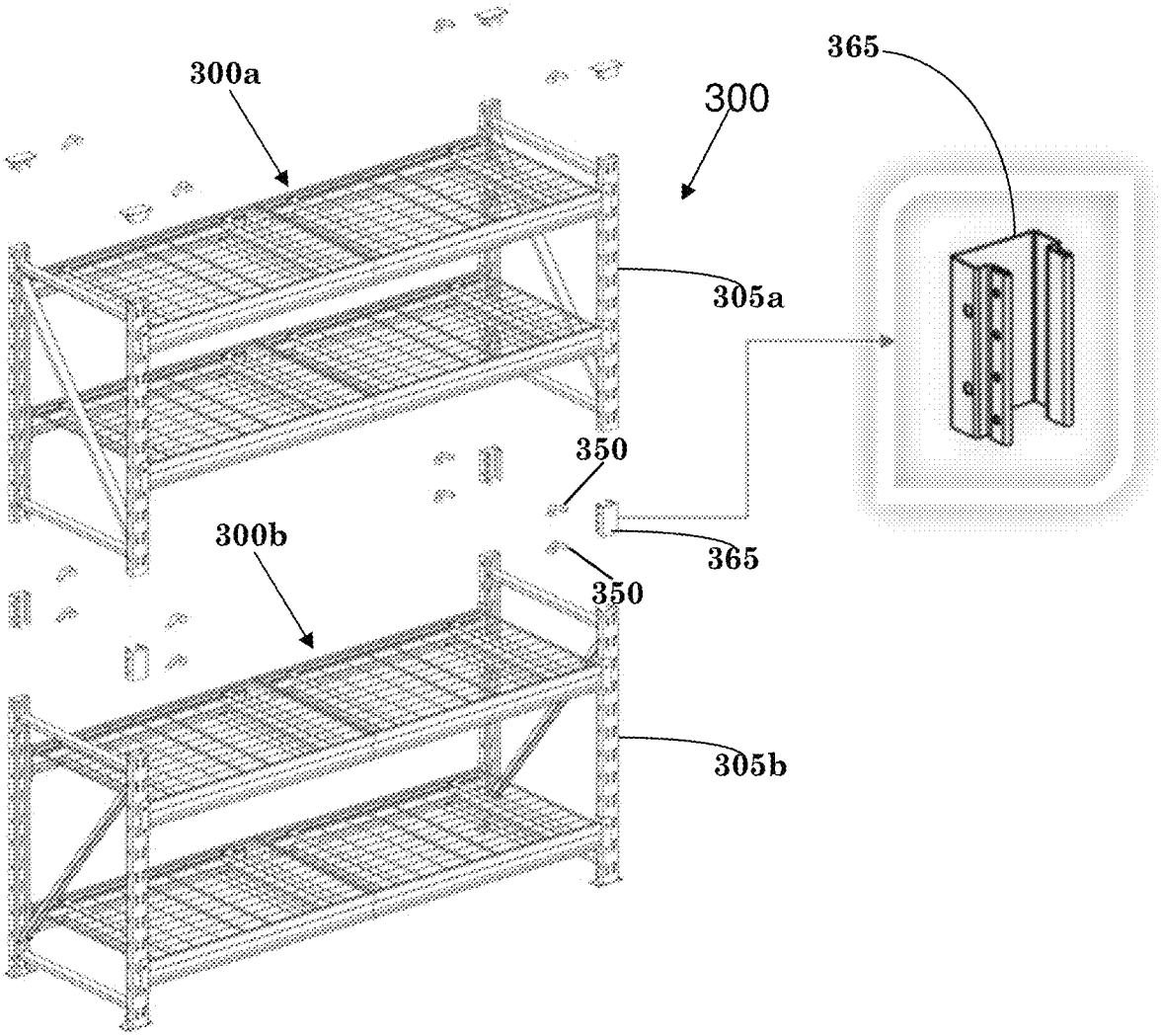
FIG. 5A shows an exploded view of two assembled racks are stacked on top of each other to form a 4-shelves free standing unit according to one exemplary embodiment.

FIG. 5A shows two assembled racks 300*a* and 300*b* are stacked on top of each other to form a 4-shelves free standing unit 300 according to one exemplary embodiment. When assembled rack 300*a* is stacked vertically on top of assembled rack 300*b*, couplers 365 are used to couple or connect posts 305*a* of top assembled rack 300*a* to posts 305*b* of assembled rack 300*b*. The coupling of the posts 305*a* and 305*b* provide stability to the 4-shelves free standing unit 300.

Figure 5B:
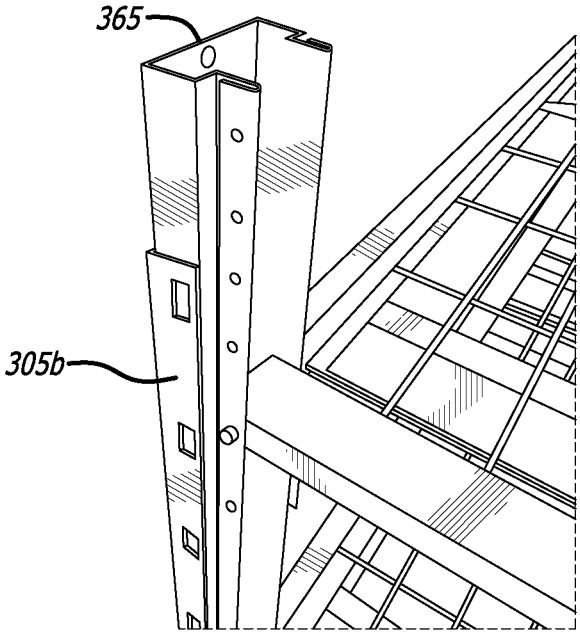
FIGS. 5B, 5C, and 5D show different views of posts of two assembled racks being coupled or connected together according to one exemplary embodiment.
Figure 5C:
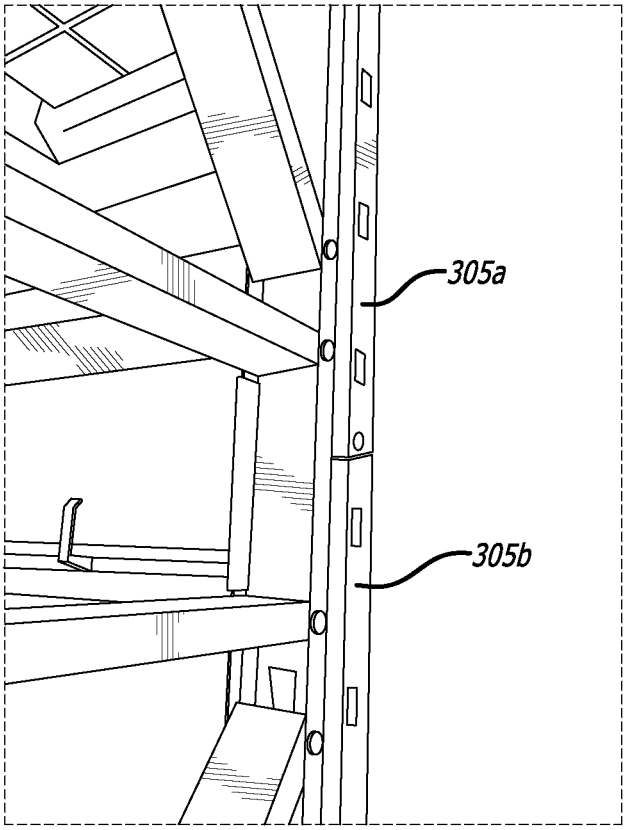
Figure 5D:
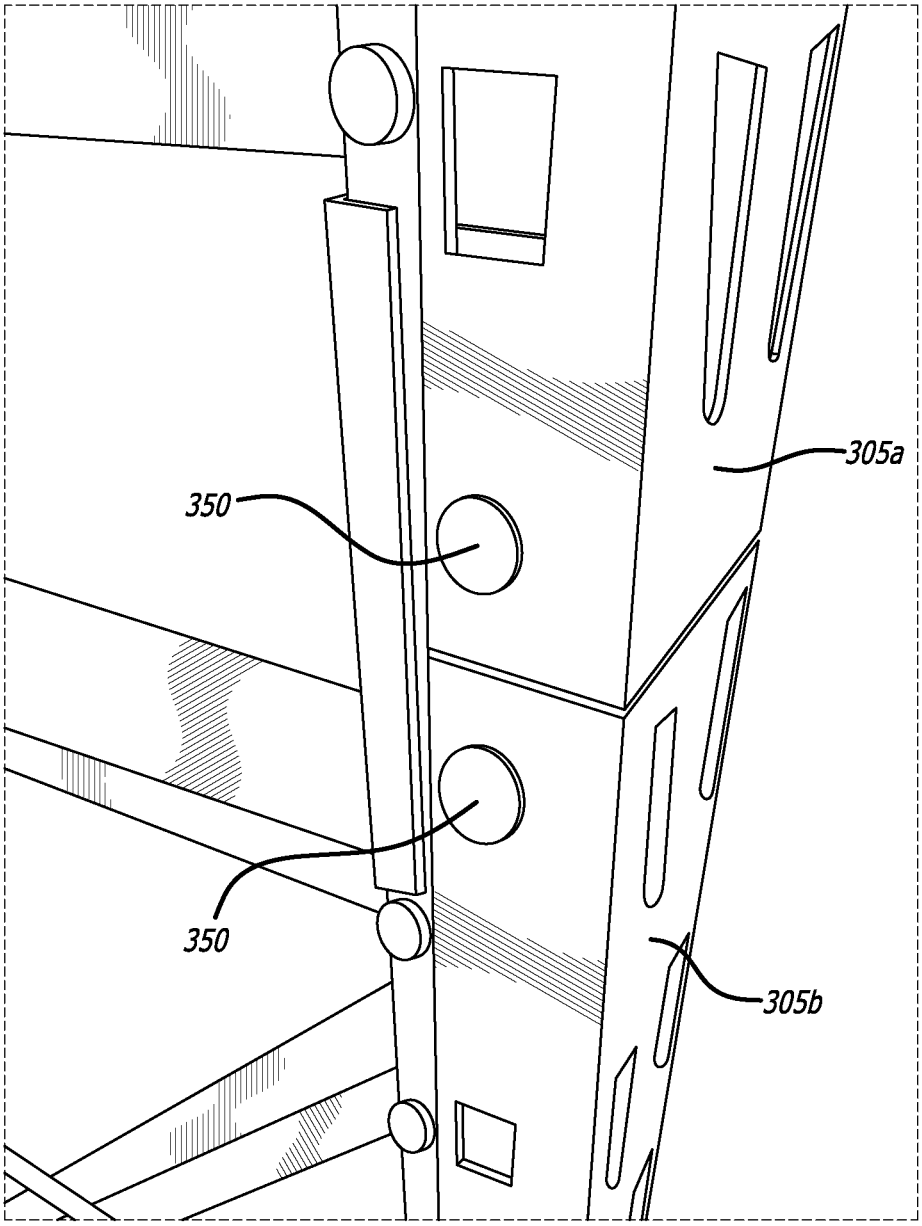

FIGS. 5B, 5C, and 5D show how the couplers 365 are used to couple or connect posts 305*a* of the top assembled rack (shown as element 330*a* in FIG. 5A) to posts 305*b* of bottom assembled rack (shown as element 330*b* in FIG. 5A). As shown in FIG. 5B, coupler is inserted in the post 305*b*. As shown in FIG. 5C, the post 305*a* of the top assembled rack is placed over the coupler; and the coupler is inserted inside the post 305*a* and is hidden from view. FIG. 5D presents another view of the post 305*a* of the top assembled rack being coupled to the post 305*b* of the bottom assembled rack with the coupler hidden from view and with L-shaped pins used to secure the posts 305*a* and 305*b* to the coupler.

Figure 5E:
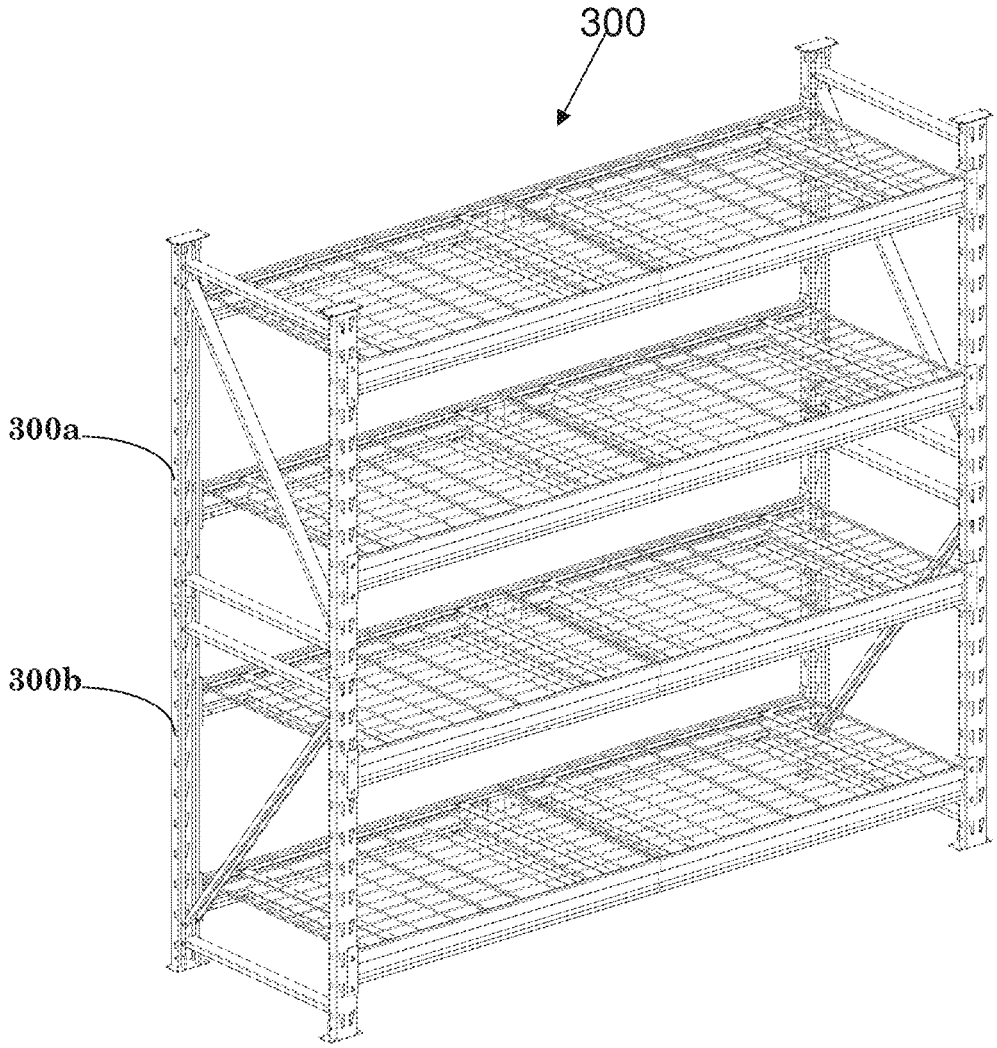
FIG. 5E shows a fully assembled free standing unit with 4 shelves for storage space according to one exemplary embodiment.

FIG. 5E shows a fully assembled free standing unit 300 with 4 shelves for storage space according to one exemplary embodiment.

Figure 6A:
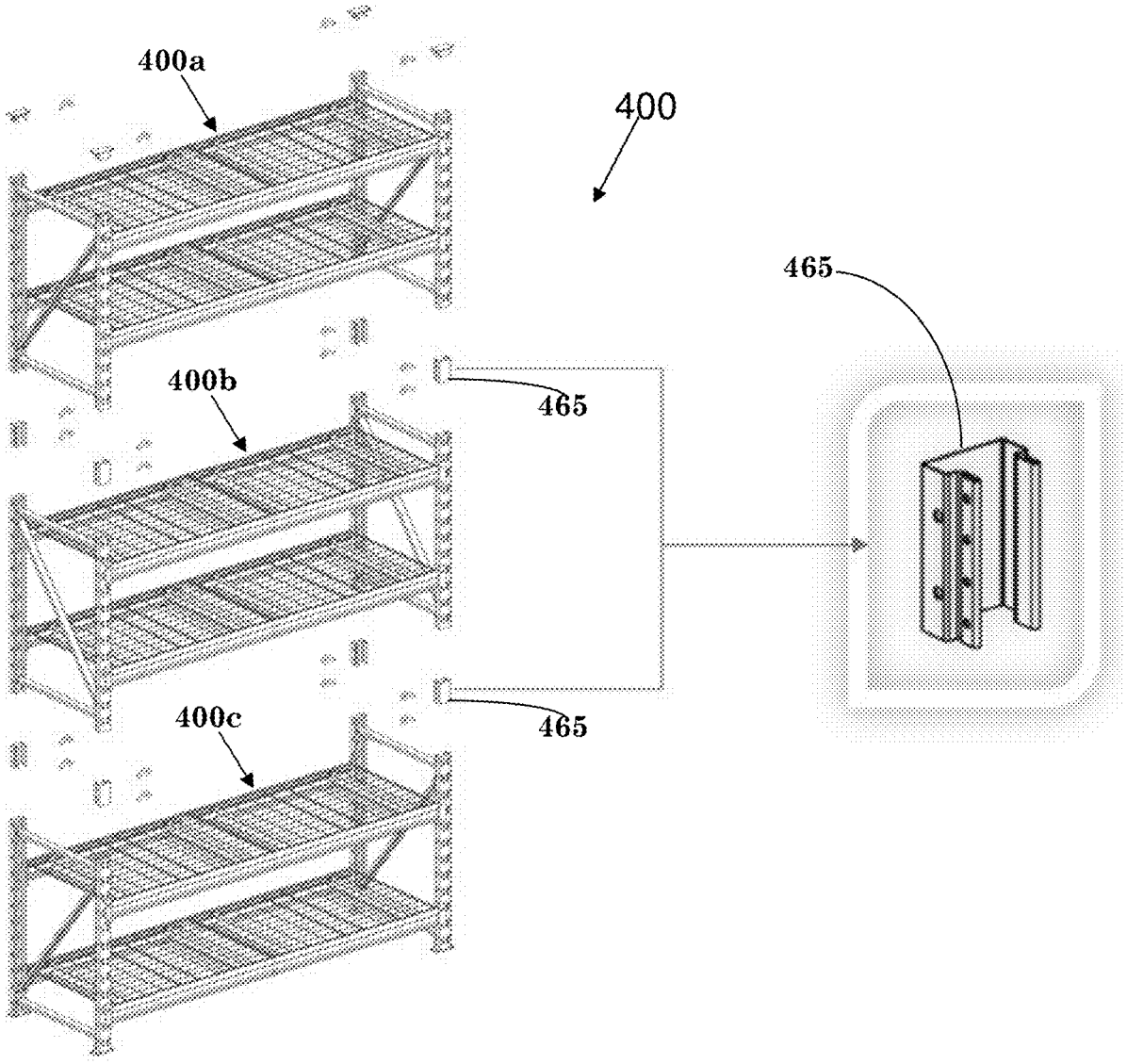
FIG. 6A shows an exploded view of three assembled racks coupled or connected together to form a free standing unit 400 according to one exemplary embodiment.
Figure 6B:
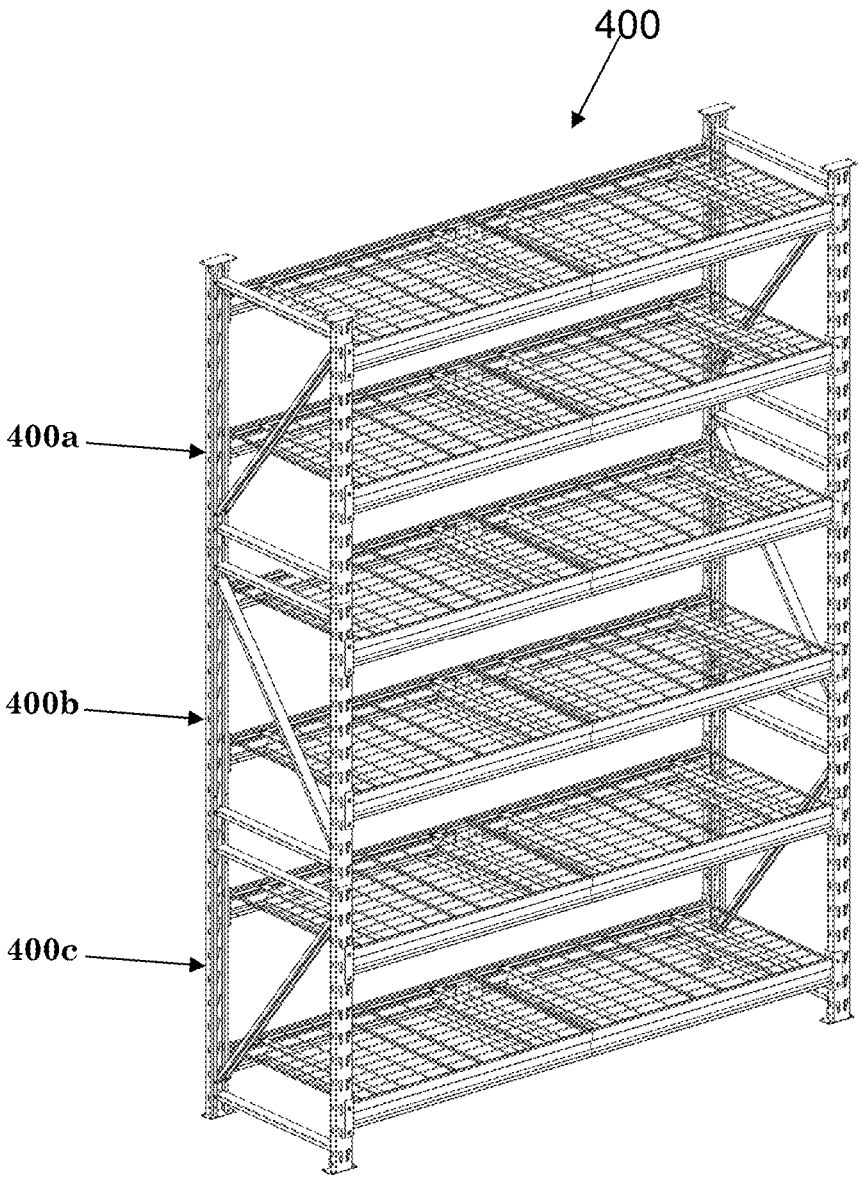
FIG. 6B shows a fully assembled free standing unit with 6 shelves for storage space according to one exemplary embodiment.

FIGS. 6A and 6B show three assembled racks 400*a*, 400*b*, and 400*c* coupled or connected together using couplers 365 to form a free standing unit 400 according to one exemplary embodiment. As shown in FIGS. 6A and 6B, the free standing unit 400 has 6 shelves for storage space. In alternative embodiments, 4 or more assembled racks can be coupled or connected together to form an even taller vertically free standing unit with more shelves than the unit 400 shown in FIGS. 6A and 6B.

Figure 7A:
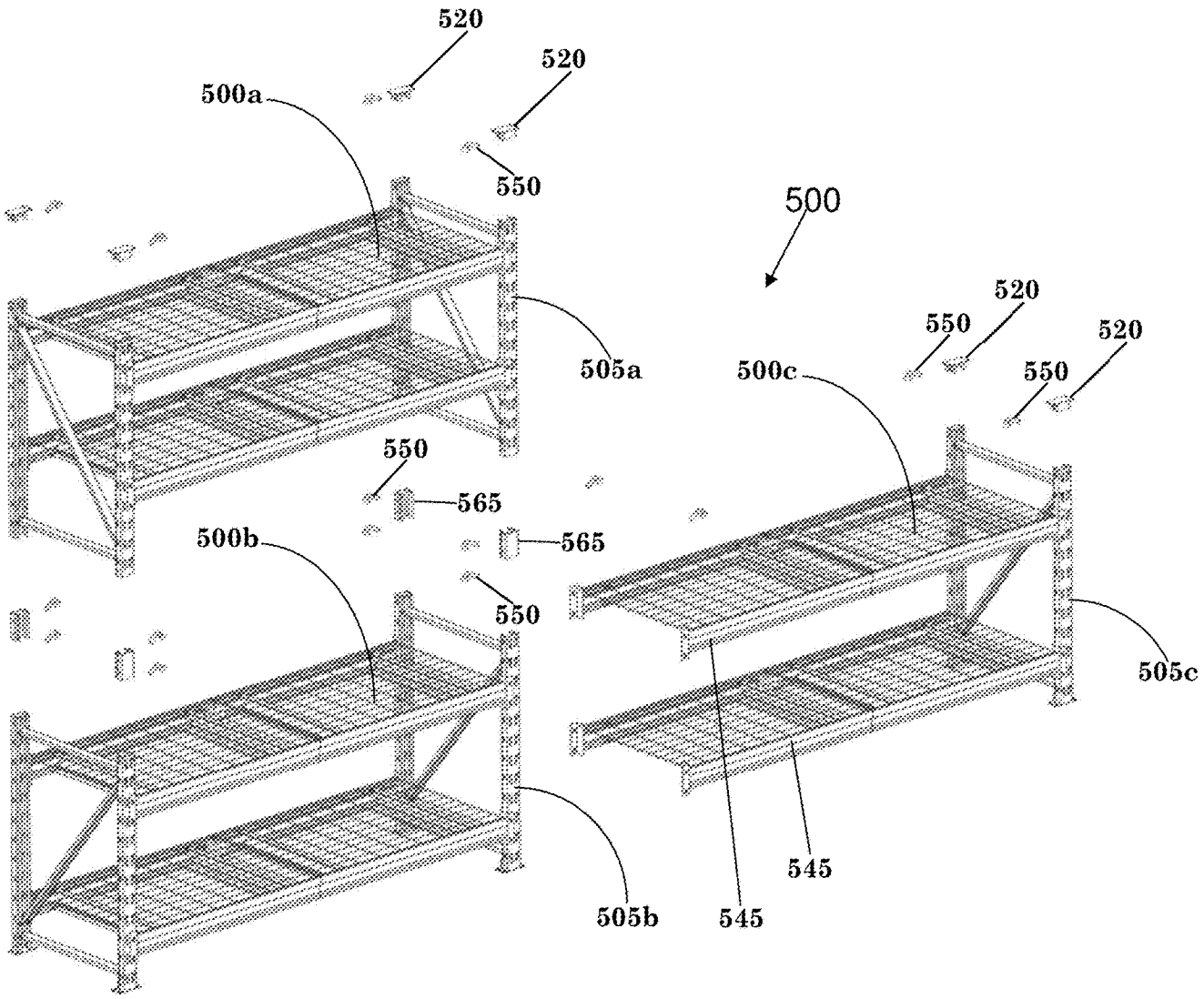
FIGS. 7A and 7B show three assembled racks coupled or connected together to form a L-shaped free standing unit according to one exemplary embodiment.
Figure 7B:
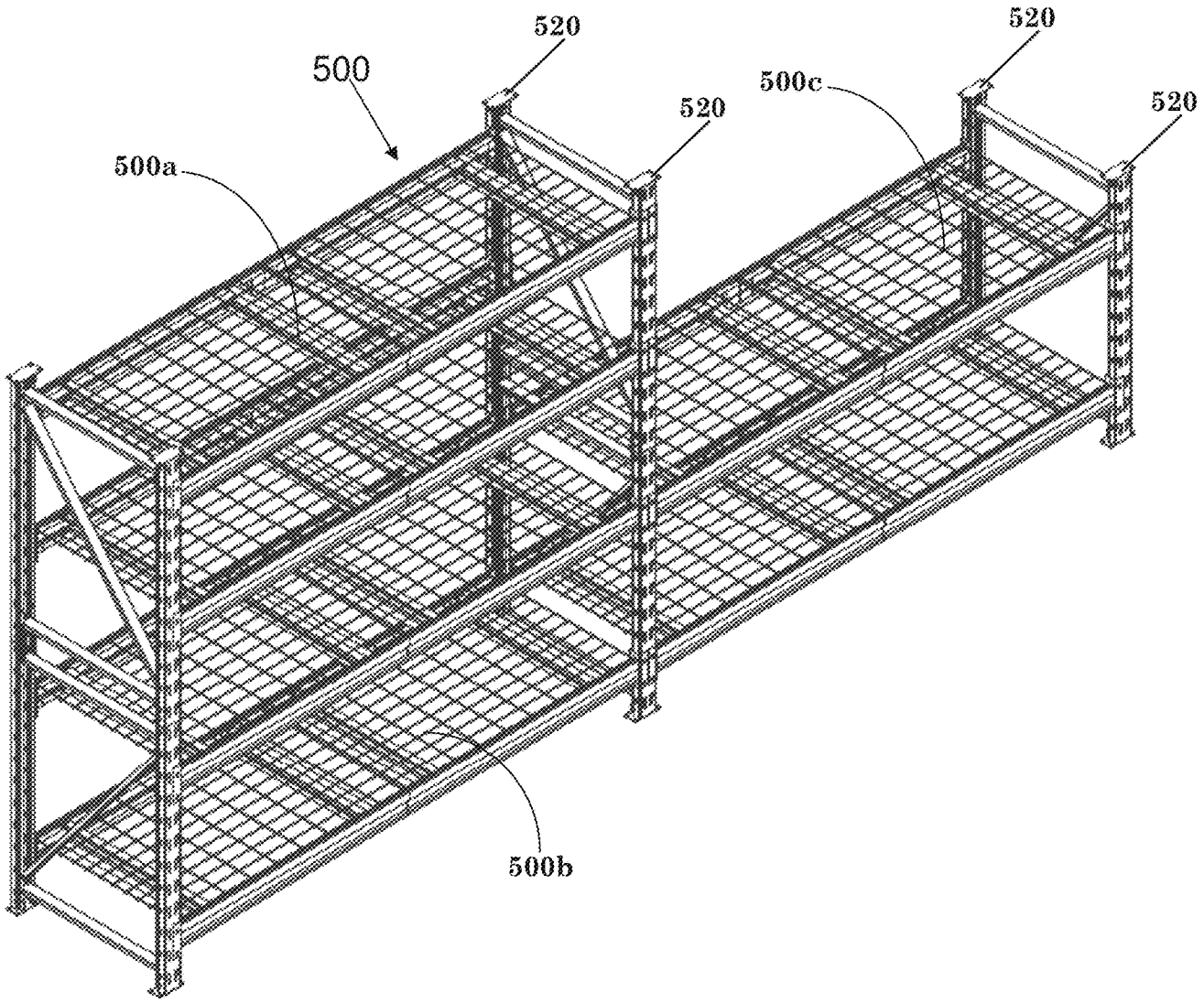

FIGS. 7A and 7B show three assembled racks 500*a*, 500*b*, and 500*c* coupled or connected together to form a L-shaped free standing unit 500 according to one exemplary embodiment. As shown in FIG. 7A, two assembled racks 500*a* and 500*b* are stacked on top of each other to form a vertically extended unit with 4-shelves. When assembled rack 500*a* is stacked vertically on top of assembled rack 500*b*, couplers 565 are used to couple or connect posts 505*a* of top assembled rack 500*a* to posts 505*b* of assembled rack 500*b*. L-shaped pins 565 are used to secure the posts 505*a* and 505*b* to the couplers 565 (as shown in FIGS. 5B-5D). Furthermore, the long beams 545 of assembled rack 500*c* are coupled or connected to the posts 505*b* of assembled rack 500*b* to horizontally extend the free standing unit 500. In one embodiment, L-shaped pins 565 can be used to secure the long beams 545 of assembled rack 500*c* to the posts 505*b* of assembled rack 200*b*. The use of L-shaped pins 550 generally facilitate easy assembling and disassembling of the rack 500. The user simply removes the L-shaped pins 550 to disassemble the rack 500.

FIG. 7B shows the assembled rack 500 with a L-shaped configuration with assembled rack 500*a* stacked on top of assembled rack 500*b* for vertical extension, and assembled rack 500*c* coupled or connected to assembled rack 500*b* for horizonal extension. As shown in FIGS. 7A and 7B, post caps 520 are coupled to the top of posts 505*a* and 505*b* to cover the posts as a safety feature. The post caps 520 can be secured to the posts using L-shaped pins 550. The use of L-shaped pins 550 generally facilitate easy assembling and disassembling of the rack 500. The user simply removes the L-shaped pins 550 to disassemble the post caps 520 from the rack 500.

Figure 8A:
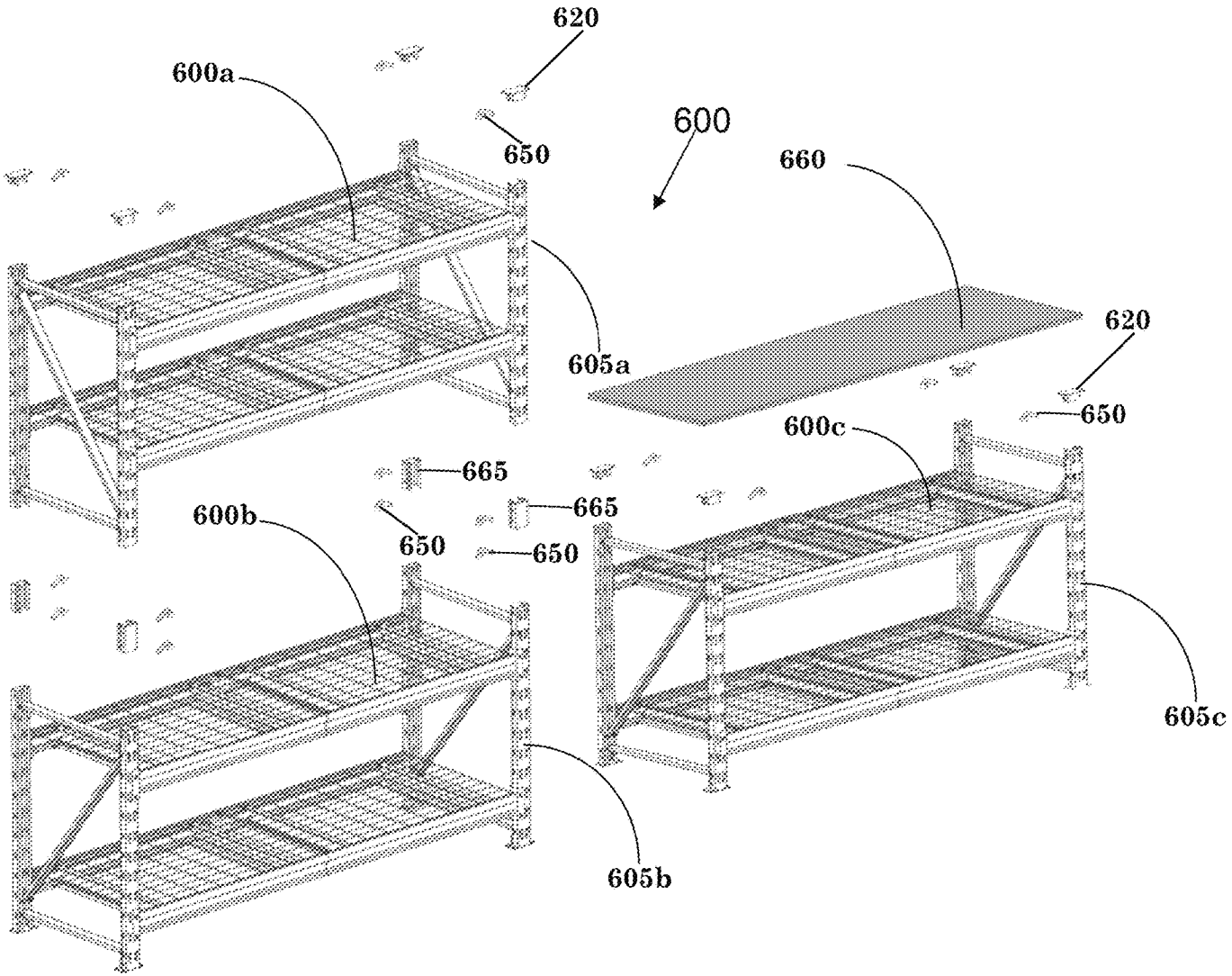
FIGS. 8A and 8B show an alternative L-shaped free standing unit formed using three assembled racks according to one exemplary embodiment.
Figure 8B:
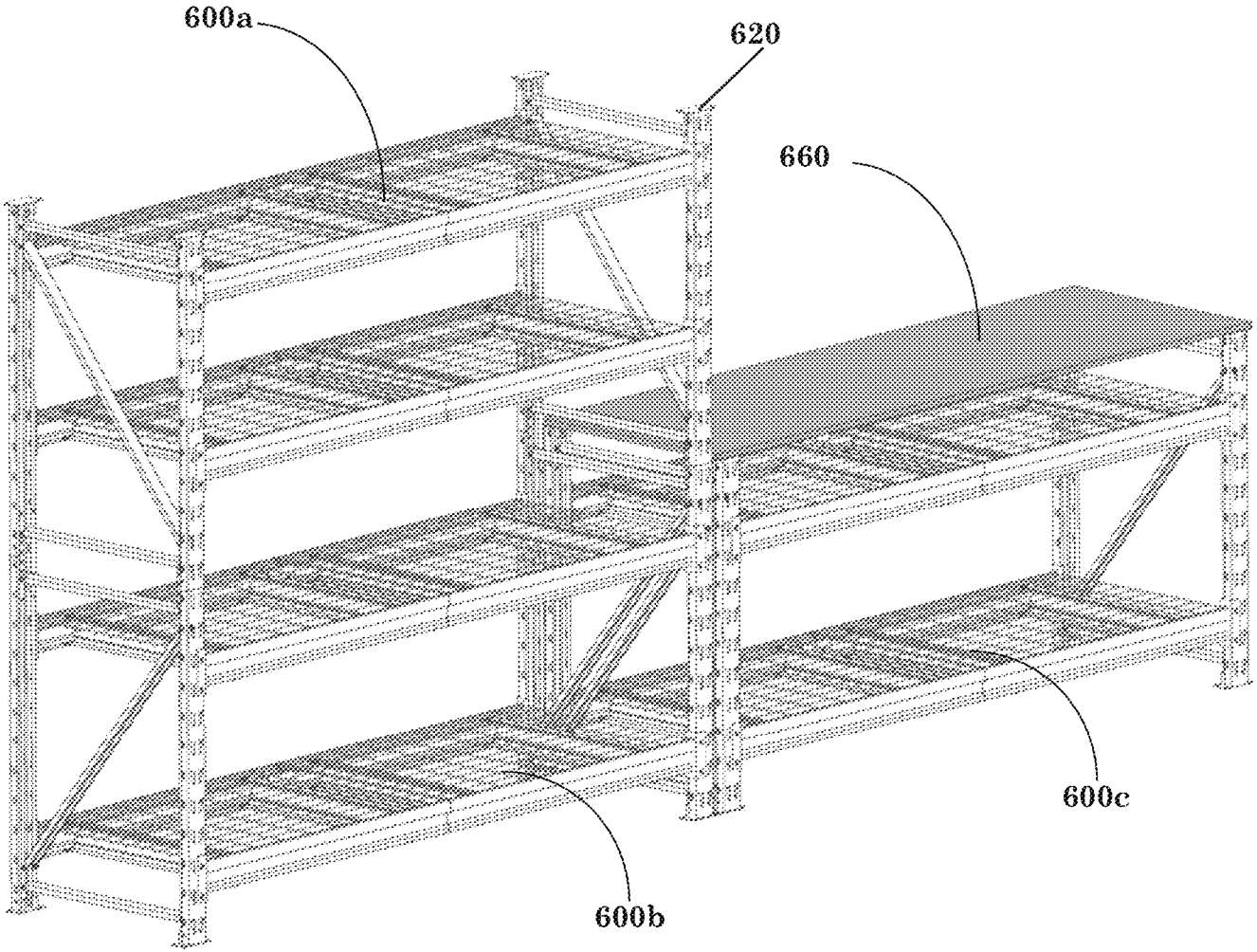

FIGS. 8A and 8B show an alternative L-shaped free standing unit 600 formed using three assembled racks 600*a*, 600*b*, and 600*c* according to one exemplary embodiment. As shown in FIG. 8A, two assembled racks 600*a* and 600*b* are stacked on top of each other to form a vertically extended unit with 4-shelves. When assembled rack 600*a* is stacked vertically on top of assembled rack 600*b*, couplers 665 are used to couple or connect posts 605*a* of top assembled rack 600*a* to posts 605*b* of assembled rack 600*b*. L-shaped pins 665 are used to secure the posts 605*a* and 605*b* to the couplers 665 (as shown in FIGS. 5B-5D). Furthermore, assembled rack 600*c* is placed next to assembled rack 600*b* to horizontally extend the unit 600.

FIG. 8B shows the assembled rack 600 with a L-shaped configuration with assembled rack 600*a* stacked on top of assembled rack 600*b* for vertical extension, and assembled rack 600*c* placed next to assembled rack 500*b* for horizonal extension. As shown in FIGS. 8A and 8B, post caps 620 are coupled to the top of posts 605*a* and 605*b* to cover the posts as a safety feature. The post caps 620 can be secured to the posts using L-shaped pins 650. The use of L-shaped pins 650 generally facilitate easy assembling and disassembling of the rack 600. The user simply removes the L-shaped pins 650 to disassemble the post caps 620 from the rack 600. Furthermore, each post cap 620 has a generally flat surface on which a flat board could be placed to form a table or a workbench. A flat board 660 is placed on top of the post caps of the assembled rack 650*c* to form a table or workbench according to one exemplary embodiment.

Various aspects of the disclosure have been described above. It should be apparent that the teachings herein may be embodied in a wide variety of forms and that any specific structure, function, or both being disclosed herein is merely representative. Based on the teachings herein one skilled in the art should appreciate that an aspect disclosed herein may be implemented independently of any other aspects and that two or more of these aspects may be combined in various ways. While various embodiments of the invention have been described, it will be apparent to those of ordinary skill in the art that many more embodiments and implementations are possible within the scope of this invention. Moreover, various features and functionalities described in this application and Figures may be combined individually and/or plurality of features and functionalities with others. Accordingly, the invention is not to be restricted except in light of the attached claims and their equivalents, the known and customary practice within the art to which the invention pertains.

The invention claimed is:

1. A storage rack system, comprising:
a first storage rack, comprising:
posts;
bottom post caps, wherein each bottom post cap is coupled to a post to provide stability to the first storage rack;
horizontal bars used to couple the posts in pairs to form the first storage rack, and to provide stability to the first storage rack;
diagonal bars used to couple the posts in pairs to form the first storage rack, and to provide stability to the first storage rack; and
shelves coupled to the posts, wherein each shelf includes half-size wire mesh decks, long beams, and support bars, the long beams are positioned on each side of the half-size wire mesh decks to form the shelf, the support bars are placed under the half-size wire mesh decks at spaced intervals and are coupled to the long beams to provide support for the shelf, and the long beams are coupled to the posts to form the first storage rack; and
a second storage rack, comprising:
posts;
bottom post caps, wherein each bottom post cap is coupled to a post to provide stability to the second storage rack;
horizontal bars used to couple the posts in pairs to form the second storage rack, and to provide stability to the second storage rack;
diagonal bars used to couple the posts in pairs to form the second storage rack, and to provide stability to the second storage rack; and
shelves coupled to the posts, wherein each shelf includes half-size wire mesh decks, long beams, and support bars, the long beams are positioned on each side of the half-size wire mesh decks to form the shelf, the support bars are placed under the half-size wire mesh decks at spaced intervals and are coupled to the long beams to provide support for the shelf, and the long beams are coupled to the posts to form the second storage rack;
wherein the second storage rack is stacked on top of the first storage rack using couplers to form a vertically stacked storage rack, and
wherein the vertically stacked storage rack is formed by inserting the couplers into the posts of the first storage rack and the posts of the second storage rack, and by using L-shaped pins to secure the posts of the second storage rack and the posts of the first storage rack to the couplers.

2. The storage rack system of claim 1, further comprises:
a third storage rack, comprising:
posts;
bottom post caps, wherein each bottom post cap is coupled to a post to provide stability to the third storage rack;
horizontal bars used to couple the posts in pairs to form the third storage rack, and to provide stability to the third storage rack;
diagonal bars used to couple the posts in pairs to form the third storage rack, and to provide stability to the third storage rack; and
shelves coupled to the posts, wherein each shelf includes half-size wire mesh decks, long beams, and support bars, the long beams are positioned on each side of the half-size wire mesh decks to form the shelf, the support bars are placed under the half-size wire mesh decks at spaced intervals and are coupled to the long beams to provide support for the shelf, and the long beams are coupled to the posts to form the third storage rack;
wherein the third storage rack is stacked on top of the second storage rack using couplers to form a six-shelves vertically stacked storage rack, the couplers are used to secure the posts of the third storage rack to the posts of the second storage rack.

3. The storage rack system of claim 1, further comprises:
a third storage rack, comprising:
posts;
bottom post caps, wherein each bottom post cap is coupled to a post to provide stability to the first storage rack;
horizontal bars used to couple the posts to form the third storage rack, and to provide stability to the third storage rack; and
diagonal bars used to couple the posts to form the third storage rack, and to provide stability to the third storage rack,
shelves coupled to the posts, wherein each shelf includes half-size wire mesh decks, long beams, and support bars, the long beams are positioned on each side of the half-size wire mesh decks to form the shelf, the support bars are placed under the half-size wire mesh decks at spaced intervals and are coupled to the long beams to provide support for the shelf, and the long beams are coupled to the posts to form the third storage rack;
wherein the long beams of the third storage rack are coupled to the posts of the first storage rack to form a horizontally extended and vertically stacked storage rack.

4. A storage rack system, comprising:
a first storage rack, comprising:
posts;
bottom post caps, wherein each bottom post cap is coupled to a post to provide stability to the first storage rack;

horizontal bars used to couple the posts in pairs to form the first storage rack, and to provide stability to the first storage rack; and diagonal bars used to couple the posts in pairs to form the first storage rack, and to provide stability to the first storage rack;

shelves coupled to the posts, wherein each shelf includes half-size wire mesh decks, long beams, and support bars, the long beams are positioned on each side of the half-size wire mesh decks to form the shelf, the support bars are placed under the half-size wire mesh decks at spaced intervals and are coupled to the long beams to provide support for the shelf, and the long beams are coupled to the posts to form the first storage rack;

a second storage rack, comprising:

posts;

bottom post caps, wherein each bottom post cap is coupled to a post to provide stability to the second storage rack;

horizontal bars used to couple the posts to form the second storage rack, and to provide stability to the second storage rack; and diagonal bars used to couple the posts to form the second storage rack, and to provide stability to the second storage rack, shelves coupled to the posts, wherein each shelf includes half-size wire mesh decks, long beams, and support bars, the long beams are positioned on each side of the half-size wire mesh decks to form the shelf, the support bars are placed under the half-size wire mesh decks at spaced intervals and are coupled to the long beams to provide support for the shelf, and the long beams are coupled to the posts to form the second storage rack;

wherein the long beams of the second storage rack are coupled to the posts of the first storage rack to form a horizontally extended storage rack; and a third storage rack, comprising:

posts;

bottom post caps, wherein each bottom post cap is coupled to a post to provide stability to the third storage rack;

horizontal bars used to couple the posts in pairs to form the third storage rack, and to provide stability to the third storage rack; and diagonal bars used to couple the posts in pairs to form the third storage rack, and to provide stability to the third storage rack, shelves coupled to the posts, wherein each shelf includes half-size wire mesh decks, long beams, and support bars, the long beams are positioned on each side of the half-size wire mesh decks to form the shelf, the support bars are placed under the half-size wire mesh decks at spaced intervals and are coupled to the long beams to provide support for the shelf, and the long beams are coupled to the posts to form the third storage rack;

wherein the third storage rack is stacked on top of the first storage rack using couplers to form a horizontally extended and vertically stacked storage rack, and wherein the vertically stacked storage rack is formed by inserting the couplers into the posts of the first storage rack and the posts of the third storage rack, and by using L-shaped pins to secure the posts of the third storage rack and the posts of the first storage rack to the couplers.

5. The storage rack system of claim 1, wherein the second storage rack includes top post caps that are coupled to the posts of the second storage rack using removable L-shaped pins.

6. The storage rack system of claim 5, wherein the top post caps of the second storage rack have a generally flat surface, and a generally flat board is placed on top of the generally flat surface of the post caps to form a work bench.

7. The storage rack system of claim 4, wherein the third storage rack includes top post caps that are coupled to the posts of the third storage rack using removable L-shaped pins.

8. The storage rack system of claim 7, wherein the top post caps of the third storage rack have a generally flat surface, and a generally flat board is placed on top of the generally flat surface of the post caps to form a work bench.

* * * * *